US006638577B2

(12) United States Patent
Sano et al.

(10) Patent No.: US 6,638,577 B2
(45) Date of Patent: Oct. 28, 2003

(54) METHOD OF MANUFACTURING GOLF CLUB HEAD

(75) Inventors: Yoshinori Sano, Kobe (JP); Takashi Nishida, Miyazaki-ken (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 10/022,522

(22) Filed: Dec. 20, 2001

(65) Prior Publication Data

US 2002/0136842 A1 Sep. 26, 2002

(30) Foreign Application Priority Data

Jan. 24, 2001 (JP) ..... 2001-16015

(51) Int. Cl.[7] ..... B05D 1/04

(52) U.S. Cl. ..... 427/475; 427/477; 427/481; 427/484; 427/486

(58) Field of Search ..... 427/458, 475, 427/477, 479, 480, 481, 483, 484–486; 361/226–228; 473/282, 292–294, 297, 304, 324, 343, 344, 349

(56) References Cited

U.S. PATENT DOCUMENTS 4,341,815 A * 7/1982 Bagby et al.
6,348,011 B1 * 2/2002 Reyes et al.

FOREIGN PATENT DOCUMENTS

| | | |
|---|---|---|
| JP | 02-207860 | 8/1990 |
| JP | 03-030850 | 8/1991 |

* cited by examiner

*Primary Examiner*—Fred J. Parker
(74) *Attorney, Agent, or Firm*—Birch, Stewart, Kolasch & Birch, LLP

(57) ABSTRACT

A method of manufacturing golf club heads comprises a process of coating golf club heads with a paint by passing the golf club heads through a space in which the paint is sprayed by an electrostatic spray coating machine so that the charged spray of the paint is attracted to the rotating golf club heads.

4 Claims, 3 Drawing Sheets

METHOD OF MANUFACTURING GOLF CLUB HEAD

BACKGROUND OF THE INVENTION

The present invention relates to a method of manufacturing golf club heads, more particularly to a method of coating golf club heads being capable of decreasing the variation of coat thickness and improving the appearance.

Usually, in order to improve the appearance of a golf club head and prevent its metallic part from getting rusty, the golf club head is provided on the surface with a thin coat, using a hand-held spray gun by hand. As the shape of a golf club head is small and not a simple and has a round part, it is difficult to make a coat with a uniform thickness and thus the spraying work requires skill. If the coat is too thin, the strength thereof decreases and the coat is liable exfoliate. Hitherto, therefore, in order to avoid this problem, a considerable quantity of paint is sprayed on the golf club head, to be precise, sprayed towards the head. As a result, most of the sprayed paint, about 75% of the whole of the discharge quantity is not used. On the other hand, in order to provide beautiful metallic luster on the surface of the golf club head, a paint containing metal powder is used. In order that the metal powder shines, it is necessary that the particles of the powder are platy and the particles are oriented in normal directions such that the thickness direction of the particle becomes almost parallel to the surface of the coat. However, in case of the above-mentioned coating method based on the hand-held spray gun, it is impossible to orient the metal powder as explained above, and the directions of the particles are random.

SUMMARY OF THE INVENTION

It is therefore, an object of the present invention to provide a method of manufacturing golf club heads in which the coat thickness is uniformed and it is possible to orient platy particles of metal powder to improve the appearance of the golf club head.

According to the present invention, a method of manufacturing golf club heads comprises a process of coating golf club heads with a paint by passing the golf club heads through a space in which the paint is sprayed by an electrostatic spray coating machine so that the paint which is sprayed is changed and attached to the golf club heads.

DESCRIPTION OF THE PREFERRED EMBODIMENT(S)

An embodiment of the present invention will now be described in detail in conjunction with the accompanying drawings.

Figure 1:
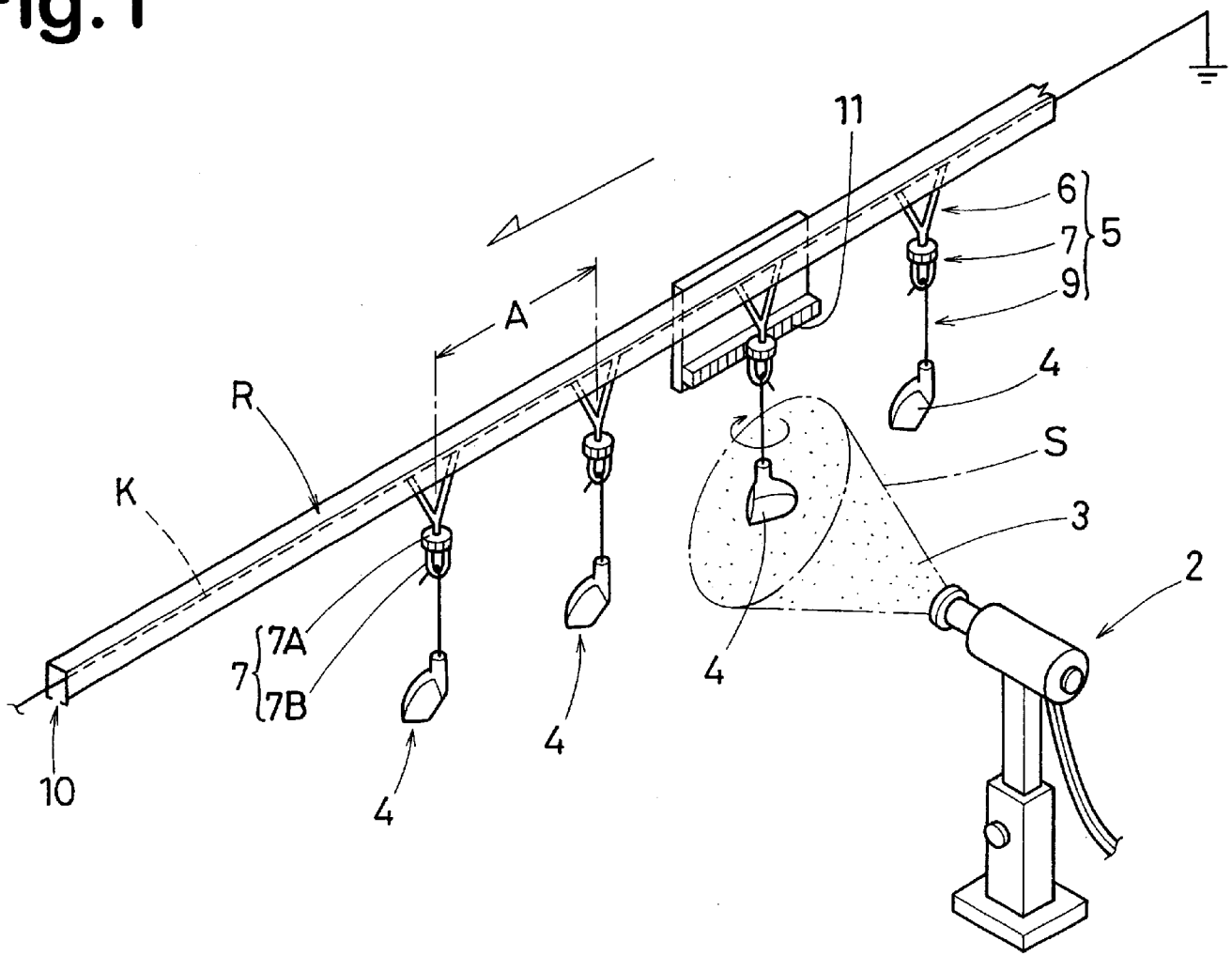
FIG. 1 is a schematic perspective view for explaining a coating process.

FIG. 1 schematically shows an example of the coating process of the method of manufacturing golf club heads according to the present invention, wherein golf club heads 4 pass through a spray chamber S in which a paint 3 is sprayed by an electrostatic spray coating machine 2 while being electrified.

By applying a high voltage in a range between −40,000 V and −100,000 V, preferably between −50,000 V and −90,000 V to the electrostatic spray coating machine 2 against the grounded golf club heads 4, the spray of the paint is electrified and attracted to the heads. In this embodiment, the electrostatic spray coating machine 2 is a bell-type coating machine, but a disk-type, gun-type and the like may be also used.

If the electrifying voltage becomes lower than 40,000 V, then the attractive force to the spray of paint decreases and there is a tendency for the coat thickness to lose the uniformity, and further in case of paint containing the metal powder, it is difficult to effectively orient the platy particles. Even if the electrifying voltage is increased over 100,000 V, the attractive force to the spray of paint does not increase anymore and other problems such as radio noise and discharge phenomenon are liable to occur.

The paint 3 may be colored or colorless transparent but it is preferable that the solvent thereof is a water solvent although it is not impossible to use organic solvents.

As to the viscosity of the paint 3, it is preferable for obtaining a good spray of the paint that the outflow time of the paint by the IWATA cup method is in a range of from 7 to 15 seconds, more preferably from 8 to 13 seconds at a temperature of 20 degrees C.

For the paint 3, that containing metal powder may be used to provide the head 4 with a beautiful metallic luster. For the metal powder, metal, metal oxide, metal nitride, metal carbide and the like may be used alone or in combination. As the metal, aluminum, titanium (sg=4.5), nickel (sg=8.9), copper (sg=8.9), molybdenum (sg=10.2), lead (sg=11.3), tungsten (sg=19.3) and their alloys may be used alone or in combination.

As the metal oxide, titanium oxide (sg=4.9), oxidization zirconium (sg=5.5), iron oxide (sg=5.7), oxidization copper (sg=6.0), oxidization lead (sg=9.3–9.6), oxidization tungsten (sg=12.1) and the like may be used.

As the metal nitride, titanium nitride (SG=5.4), copper nitride (SG=5.8), chromium nitride (SG=5.9), zinc nitride (SG=6.2), iron nitride (SG=6.4), zirconium nitride (SG=7.1), tantalum nitride (SG=14.4) and the like may be used.

The average particle diameter of the metal powder is set in a range of from 0.05 to 50 micrometers, preferably from 0.1 to 30 micrometers, more preferably from 0.1 to 15 micrometers. It is preferable that the average particle diameter is decreased as far as possible while taking the cost, productivity, etc. into consideration. If the average particle diameter is too large, the dispersion of the metal powder in the paint becomes not good and tends to decrease the coat strength.

The use of the metal powder having a specific gravity of more than 4 is effective in increasing the weight of the head 4 near the surface. For this purpose, the weight of the metal powder included in the coat on a head is preferably set in a range of from 1.5 to 7.5%, more preferably 2.0 to 3.5% of the gross weight of the head. Thereby, the head speed can be increased in the downward movement. Accordingly, the content of the metal powder in the paint is so determined.

Figure 2A:
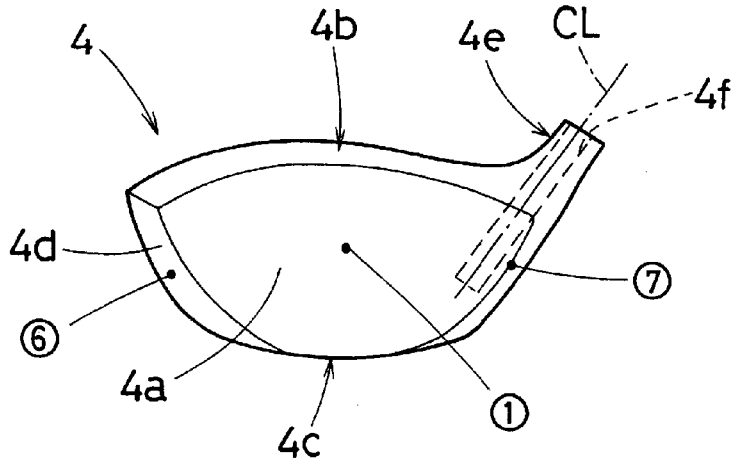
FIG. 2A is a front view of a wood-type metal golf club head.
Figure 2B:
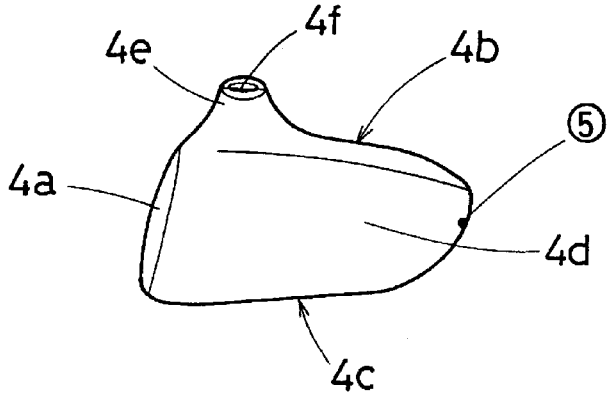
FIG. 2B is a right side view thereof.
Figure 2C:
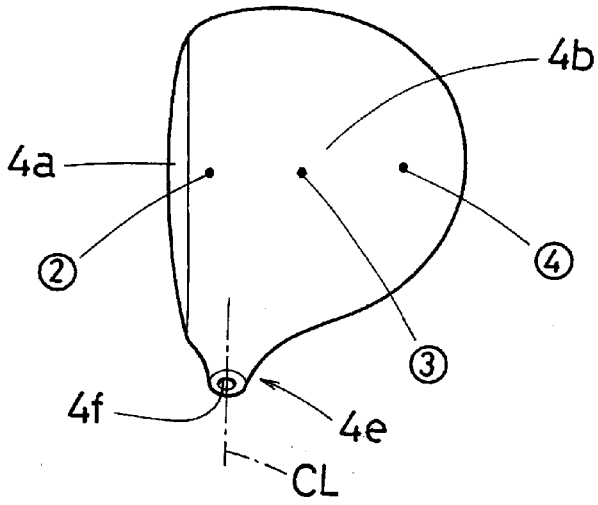
FIG. 2C is a top view thereof.

In FIGS. 2A, 2B and 2C, the head 4 shown is for a metal wood club, which comprises a face part 4*a* defining the front face including a ball hitting face, a crown part 4*b* defining the top face of the head 4, a sole part 4*c* defining the bottom face of the head 4, a side part 4*d* defining the side face between the top and bottom faces excluding the ball hitting face, and a neck part 4*e* having a shaft inserting hole 4*f* into which a shaft (not shown) is inserted. When the shaft is inserted, the axis of the shaft aligns with the axis CL of the shaft inserting hole 4*f*.

The head 4 is made of a metallic material, and prior to the coating process, surface treatment and surface preparation such as washing, shot blast and shot peening are carried out. For the head 4, an electrically conductive metallic material such as titanium, titanium alloy, stainless steel, maraging steel, aluminum alloy, beryllium copper, soft iron, Magnesium alloy, and amorphous alloy, is preferably used.

In this embodiment, as shown in FIG. 1, the heads 4 are hanged on carriers 5 which moves along a conveyer rail R, and the heads 4 are let into the above-mentioned spray chamber S one after another, and while moving in the chamber S, the heads 4 are coated with the electrostatic spray coating machine 2.

In the spray chamber S, the conveyer rail R extends straight in a horizontal direction. The conveyer rail R is provided on the underside with a continuous slit 10 onto which a runner 6 of the carrier 5 is slideably mounted. In the conveyer rail R, an endless tension conveying means K such as wire, chain, belt and the like which can move along the conveyer rail R is provided. The tension conveying means K may be made of a conductive material and moved by an electric motor. As a result, the carriers 5 are moved along the conveyer rail R.

The runner 6 in this example is Y-shaped and the upper ends of the two-forked parts are fixed to the tension conveying means K in order to prevent leaning in the running direction and revolution or twist. At the lower end of the runner 6, a rotator 7 being rotatable around a perpendicular axis is disposed. The rotator 7 has a cogged part 7A around its rotational axis and a hanger-holding part 7B having a horizontal through hole is formed at the lower end.

When the carrier 5 in the spray chamber S passes the electrostatic spray coating machine 2, the cogged part 7A gears with a rack 11 which may be fixed to the conveyer rail R, and rotates the hanger-holding part 7B at a predetermined speed around its perpendicular rotational axis.

The head 4 is hung with a hanger 9 made of a electronically conductive metallic material. The hanger 9 comprises a shaft provided with a bent part at the upper end and a screwed part at the lower end. The bent part is hooked on the hanger-holding part 7B, and the screwed part is inserted into the shaft inserting hole 4*f* of the neck part 4*e* and fixed thereto by screwing. The head 4 is grounded through the hanger 9, hanger-holding part 7B and runner 6 of the carrier 5 and the tension conveying means K or conveyer rail 6.

The distance (A) between the hung heads 4 is preferably set in a range of from 100 to 300 mm more preferably 160 to 230 mm. If the distance (A) is less than 100 mm, the variation of the coat thickness is liable to increase. If more than 300 mm, the spray not used is liable to increases.

The speed of the carrier 5 at which the head 4 passes the electrostatic spray coating machine 2 in the spray chamber S is preferably set in a range of from 1.2 to 2.5 meter/min, more preferably 1.5 to 2.4 meter/min, still more preferably 1.8 to 2.4 meter/min. If the speed is less than 1.2 meter/min, there is a tendency for the production efficiency to fall and further although it depends on the discharge quantity of the paint, there is a tendency for the coat thickness to increase. If the speed is more than 2.5 meter/min, it becomes difficult to obtain a sufficient coat thickness.

In order to decrease the variation in the coating thickness, the rotational speed of the rotator 7, namely, the rotational speed of the head during taking the paint spray is set in a range of from 3 to 20 rpm, preferably 8 to 20 rpm, more preferably 5 to 12 rpm.

Figure 3A:
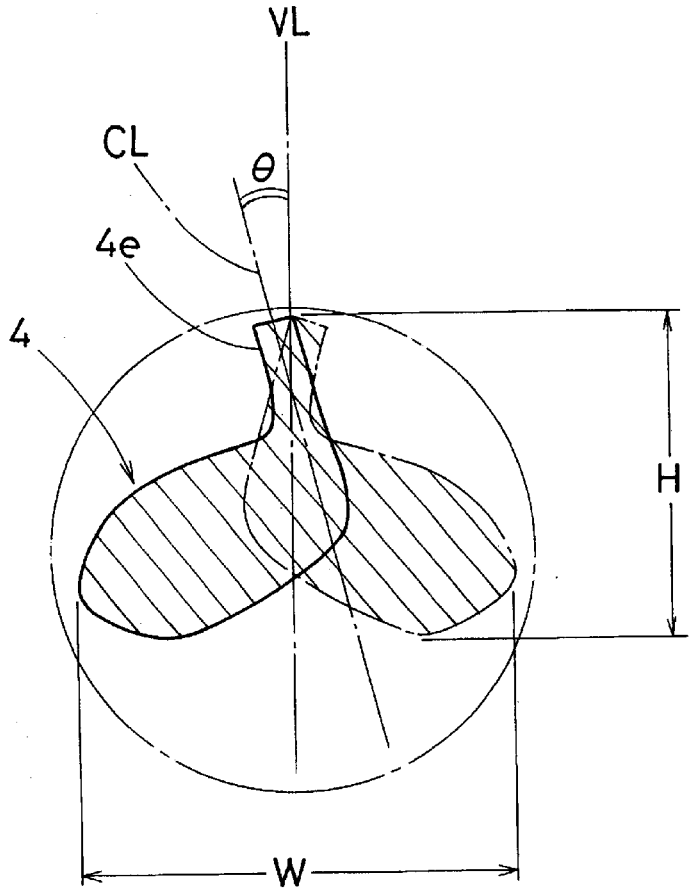
FIGS. 3A and 3B are diagrams for explaining the rotation of the golf club head during coating.
Figure 3B:
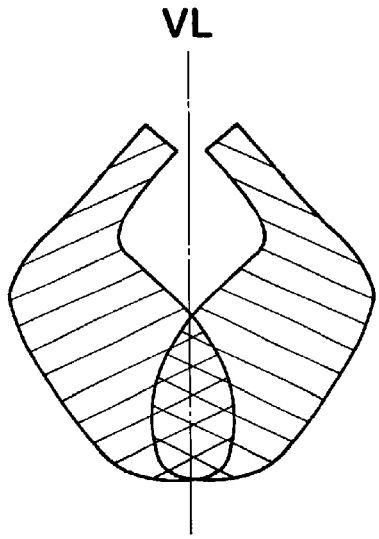

In rotating the head 4, it is possible to rotate the head 4 around the axis CL of the shaft inserting hole 4*f* with setting the axis CL perpendicularly by using the hanger 9 whose shaft is straight. However, the hanger 9 whose shaft is bent at a certain angle may be useful to save the paint. As shown in FIG. 3A, when viewed from the electrostatic spray coating machine 2, the shadow of the rotating head 4 has a circumscribing circle. It is preferable that the diameter of the circumscribing circle is decreased as far as possible. Therefor, it is preferable that the ratio (W/H) of the maximum width W to maximum height H of the shadow of the rotating head 4 is in a range of from 0.5 to 3.0 more preferably 0.7 to 2.0. Further, the maximum inclination angle θ of the axis CL of the shaft inserting hole 4*f* is preferably in a range of from 20 to 50 degrees, more preferably 30 to 40 degrees with respect to the rotational axis VL of the rotator 7 or the perpendicular axis in this embodiment. FIG. 3B shows another example of the shadow of the rotating head 4 as a result of bending the shaft of the hanger 9 in the reverse direction to that in the former example.

Thus, the surface of the head 4 is uniformly coated during passing through the spray chamber S. Then, the sprayed paint is dried into a hard coat by passing the head 4 through a hot chamber to apply a temperature of about 80 to 200 degrees C. for about 1 to 15 minutes.

The thickness of the dried coat is preferably in a range of from 10 to 100 micrometers, more preferably in a range of from 30 to 75 micrometers. If the thickness is less than 10 micrometers, the durability of the coat decreases, and the luster will soon be lost. If the thickness is more than 100 micrometers, the rigidity of the coat may become high too much, and cracks are liable to occur.

In the above-mentioned embodiment, the head 4 is a wood type, but the invention can be applied to other types of heads such as iron type and putter type.

Comparison Tests

Wood-type golf club heads made of a titanium alloy Ti-6Al-4V having a volume of 300 $cm^3$ were prepared and coated with a paint containing aluminum powder under the conditions shown in Table 1, and the coat thickness was measured at seven points ① to ⑦ shown in FIGS. 2A, 2B and 2C.

In Ex.1 to Ex.9, an bell-type electrostatic coating machine was used. (Bell rotational speed: 35000 rpm, Voltage: 70,000 V, Paint discharge quantity: 32 cc/min) The intervals of the heads on the conveyer rail were 200 mm. The maximum width-height ratios (W/H) in rotating was 1.0.

In the Ref., a hand-held spray gun was used to apply a single one-time coating.

The test results are shown in Table 1.

TABLE 1

| | Ex.1 | Ex.2 | Ex.3 | Ex.4 | Ex.5 | Ex.6 | Ex.7 | Ex.8 | Ex.9 | Ref. |
|---|---|---|---|---|---|---|---|---|---|---|
| Carrier speed (meter/min) | 1.8 | 1.0 | 2.7 | 1.8 | 1.8 | 2.4 | 1.3 | 1.8 | 1.8 | — |
| Rotator speed (rpm) | 8 | 8 | 8 | 2 | 8 | 8 | 8 | 20 | 24 | — |
| Aangle ⊖ (deg) | 35 | 35 | 35 | 35 | 5 | 35 | 35 | 35 | 35 | — |
| Weight of coat (g) | 1.6 | 2.2 | 1.0 | 1.5 | 1.5 | 1.2 | 1.9 | 1.7 | 1.5 | 1.6 |

TABLE 1-continued

| | Ex.1 | Ex.2 | Ex.3 | Ex.4 | Ex.5 | Ex.6 | Ex.7 | Ex.8 | Ex.9 | Ref. |
|---|---|---|---|---|---|---|---|---|---|---|
| Coat thickness (micrometer) | | | | | | | | | | |
| Position ① | 40 | 100 | 30 | 21 | 60 | 35 | 45 | 39 | 41 | 40 |
| ② | 51 | 90 | 38 | 80 | 80 | 41 | 53 | 45 | 47 | 60 |
| ③ | 55 | 100 | 25 | 95 | 95 | 50 | 54 | 57 | 52 | 70 |
| ④ | 52 | 110 | 35 | 104 | 90 | 50 | 52 | 54 | 55 | 98 |
| ⑤ | 65 | 120 | 20 | 90 | 57 | 55 | 70 | 63 | 60 | 112 |
| ⑥ | 45 | 75 | 10 | 80 | 13 | 40 | 51 | 51 | 47 | 45 |
| ⑦ | 50 | 80 | 6 | 84 | 113 | 43 | 53 | 48 | 53 | 105 |

From the test, it was confirmed that the variation of the coat thickness can be minimized.

What is claimed is:

1. A method of manufacturing golf club heads comprising coating golf club heads with a paint by passing is sprayed by an electrostatic spray coating machine wherein the golf club heads are grounded and the paint that is sprayed is electrically charged against the grounded golf club heads with an applied high voltage, and rotating the golf club heads in said space at a rotational speed of 3 to 20 rpm during passing the electrostatic spray coating machine, wherein when viewed from the electrostatic spray coating machine, the shadow of the rotating head is such that the ratio (W/H) of maximum width (W) to a maximum height (H) of the shadow is in a range of from 0.5 to 3.0 and a maximum inclination angle (q) of the axis (CL) of a shaft inserting hole of the head is in a range of from 20 to 50 degrees with respect to the rotational axis of the head.

2. A method of manufacturing golf club heads according to claim 1, which further comprises hanging the golf club heads on carriers during passing through across said space.

3. A method of manufacturing golf club heads according to claim 2, wherein the golf club heads in said space are arranged at intervals of 100 to 300 mm.

4. A method of manufacturing golf club heads according to claim 1, wherein the paint contains metal powder.

* * * * *